US005443005A

United States Patent [19]

Platsch

[11] Patent Number: 5,443,005

[45] Date of Patent: Aug. 22, 1995

[54] DUSTING DEVICE

[76] Inventor: Hans G. Platsch, Kupferstr. 40, D-70565 Stuttgart, Germany

[21] Appl. No.: 256,550

[22] PCT Filed: Feb. 25, 1993

[86] PCT No.: PCT/EP93/00432

§ 371 Date: Jul. 20, 1994

§ 102(e) Date: Jul. 20, 1994

[87] PCT Pub. No.: WO93/17866

PCT Pub. Date: Sep. 16, 1993

[30] Foreign Application Priority Data

Mar. 6, 1992 [DE] Germany ..... 42 07 118.6

[51] Int. Cl.[6] ..... B41L 23/22; B41L 23/20

[52] U.S. Cl. ..... 101/424.2; 101/424.1; 101/416.1; 101/417

[58] Field of Search ..... 101/416.1, 417, 419, 101/424.1, 424.2, 423

[56] References Cited

U.S. PATENT DOCUMENTS

| | | | |
|---|---|---|---|
| 3,053,180 | 9/1962 | Doyle | 101/416.1 |
| 3,333,570 | 8/1967 | Paasche | 101/424.2 |
| 4,024,815 | 5/1977 | Platsch | 101/416.1 |
| 4,332,198 | 6/1982 | Schmoeger | 101/424.2 |
| 4,867,063 | 9/1989 | Baker et al. | 101/474.2 |
| 4,882,992 | 11/1989 | Schmoeger | 101/424.1 |

*Primary Examiner*—Edgar S. Burr
*Assistant Examiner*—Lynn D. Henderickson
*Attorney, Agent, or Firm*—Lowe, Price, LeBlanc & Becker

[57] ABSTRACT

A device for dusting flat products such as printed matter with a powder includes a powder box open toward a product transport surface on which a plurality of the products which are to be dusted are moved. The powder box has a powder nozzle arrangement including a first plurality of compressed air/powder delivering nozzles arranged transversely to a product transport direction at an upstream edge of the powder box, and a second similar nozzle arrangement at a downstream edge of the powder box, the two nozzle arrangements cooperating to product an air current directed towards the product transport surface. First and second suction nozzle arrangements are also similarly provided, respectively downstream of the first air nozzle arrangement and the second air nozzle arrangement, both suction nozzle arrangements also being oriented transversely to the product transport surface. A first portion of the back wall of the powder box, assigned to a downstream portion thereof, is disposed to be at a greater distance from the product transport surface than is a second portion of the back wall assigned to a relatively upstream box portion adjacent to the first and second air nozzle arrangements.

11 Claims, 3 Drawing Sheets

20
22
24
26
28
30
32
33
34
36
38
40
42
44
46
48
50
52
54
56
58
60
62
64
72
74
76
82
10
14
16
18
H
h
W
11
11

DUSTING DEVICE

FIELD OF THE INVENTION

The invention relates to a device for dusting flat products, especially printed products, with a powder.

A dusting device of known kind is described in DE-PS 22 07 983. In the case of that device, an upstream and downstream air curtain ensures that no powder dust leaves the actual treatment chamber. Removal of the air in the interior by suction ensures that the air curtains divide cleanly and without turbulence at their free end adjacent to the product transport plane and that excess powder is continuously drawn off from the treatment chamber. Such dusting devices have proved successful in practice.

In modern printing machines, distinctly increased transport speeds are used and, in order to ensure that the printed products are nevertheless dusted sufficiently well that they also continue not to stick together, it is per se necessary to have a powder box that has been enlarged in the direction of transport.

SUMMARY OF THE INVENTION

It has been realized that a powder box having only small dimensions will suffice, despite the increased transport speeds, if, on the one hand, the powder density in the powder/air mixture is increased whilst at the same time, however, by improving the dynamic sealing of the powder box and improving the flow relationships in the powder box itself, undue soiling of the surroundings, as would otherwise result from increasing the powder density, is counteracted.

This becomes possible according to the invention by means of a dusting device having the features specified in claim 1.

A powder box comprising two box portions having cover walls at different distances from the product transport plane can be obtained with little expenditure.

Advantageous developments of the invention are indicated in the subclaims.

As a result of the development of the invention according to claim 2, despite the increased powder density in the interior of the powder box, no undesirable powder deposit layers are obtained on the ceiling of the downstream box portion. Such layers could fall off in an uncontrolled manner and render high-quality printed products unusable.

When the products to be dusted are transported at very high speeds, they transmit impulses to the powder-/air mixture in the powder box. By means of the development of the invention according to claim 3 it is possible to compensate for that entraining effect. Even better sealing of the downstream end of the powder box is achieved in that manner.

According to DE-PS 22 07 983, described earlier, the downstream suction nozzle arrangement is situated in front of the downstream air nozzle arrangement, viewed in the direction of transport. That side-by-side arrangement results in very sharp deflection of the air in a small area. The development according to claim 5 provides for the downstream suction nozzle arrangement to be situated in the end wall of the box above the downstream air nozzle arrangement, thereby producing a less sharply bent circulation which covers a larger area of the end of the box, that is to say more a roller of air rotating counter to the transport direction than a curtain of air meeting the transport surface at right angles. That applies particularly when the downstream air nozzle arrangement is inclined.

Other developments of the invention according to claims 6 to 8 serve to improve the lateral sealing of the dusting device.

If a printed product flutters or undulates as it is moved through the dusting device, that has an adverse effect on the flow relationships in the interior of the dusting device and on the dynamic sealing of the powder box. The development of the invention according to claim 9 ensures that the products to be dusted are aligned very precisely with their intended transport surface. The printed products, which are consequently mechanically smooth as far as the powder/air mixture is concerned, can therefore take, at most, only very small amounts of unbound powder out of the powder box in addition to the powder adhering to the still wet printing inks.

The development of the invention according to claim 10 is again advantageous with a view to improving the lateral sealing of the powder box.

By means of the development of the invention according to claim 11 an additional, electrostatic seal is obtained at the downstream end of the powder box. The high-voltage source used to put the downstream air nozzle arrangement at high voltage is polarised in such a manner that the electric field generated drives powder particles back into the interior of the powder box.

BRIEF DESCRIPTION OF THE DRAWINGS

The invention is described in detail below with the aid of a preferred embodiment and with reference to the drawings, in which.

DETAILED DESCRIPTION OF THE PREFERRED EMBODIMENTS

Figure 1:
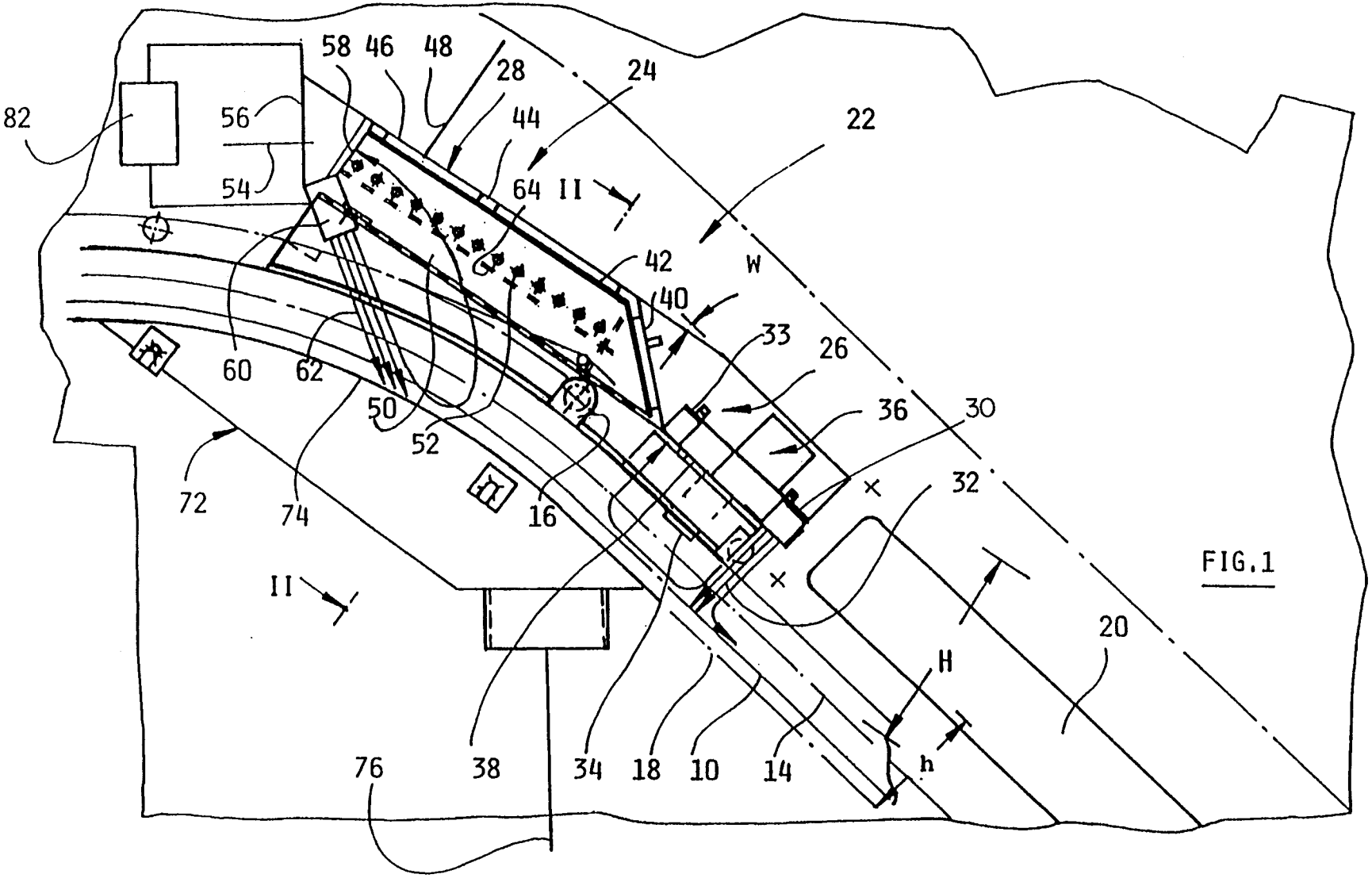
FIG. 1 shows a vertical section through a dusting device for printed products, according to a preferred embodiment, which is arranged downstream of a drier at the upper end of an ascending transport path section in a printing machine.

As best seen in FIG. 1, 10, 12 denote two chain guides in which conveyor chains 14, indicated merely schematically, are guided. The conveyor chains 14 carry aligned pairs of spaced lugs 16 which in turn carry driving members, not shown, for printed products. The transport surface along which the printed products are moved is indicated by a dot-dash line at 18.

In FIG. 1, the upper end of an ascending transport path section and a section bending into the horizontal are shown. Arranged in the ascending transport path section is a drier 20, indicated merely schematically, which dries the wet printing inks by hot air and/or radiation.

In order to prevent the printed products from sticking together by means of the printing inks, which are still tacky even downstream of the drier 20, a dusting device, designated 22 overall, is provided downstream of the drier 20.

The dusting device has a powder box, designated 24 overall, comprising an upstream box portion 26 and a downstream box portion 28.

The upstream box portion 26 is constructed to have in its upstream end a compressed air channel 30 of square cross-section which is equipped in its wall that faces the transport surface 18 with a plurality of nozzles which together produce an upstream air curtain 32 directed at right angles towards the transport surface 18.

Provided downstream of and parallel to the compressed air channel 30 is a suction channel 33 having suction apertures pointing towards the transport surface 18. Downstream of the compressed air channel 30 and upstream of the suction channel 33 viewed in the direction of transport, a powder channel 34 is provided to which a powder/air mixture is supplied from a diffuser 36 indicated merely schematically. The diffuser 36 may be constructed as described, for example, in DE-OS 38 19 203, to which reference is made in that respect.

The upstream box portion 26 is closed towards the transport surface 18 by a wall 38 the distance of which from the transport surface 18 is marked by "h".

The box portion 28 is altogether inclined with respect to the box portion 26 by a small angle w. That inclination is selected with a view to adaptation to the curved transport surface 18.

Adjoining the downstream end of the wall 38 is a wall 40 which extends away from the transport surface 18 at an angle of approximately 45°. The downstream end of the wall 40 is connected to a wall 42 which extends parallel to the outer surface of the downstream box portion 28. The wall 42 has a distance from the transport surface 18 that is distinctly greater than that of the wall 38. The average distance corresponds to the length "H".

The walls 40 and 42 are formed of an air-permeable microporous material, for example a sintered material produced from fine polyethylene particles.

The walls 40 and 42 are fastened to strips 44 which in turn are carried by external boundary walls 46 of the downstream box portion 28. The flat space situated between the external boundary walls 46 and the walls 40, 42 is connected via a line 48 to a source of compressed air.

Box profiles 50 form the side walls of the downstream box portion 28. They are in communication with the interior of the box portion 28 via a perforated wall 52 and are connected via a line 54 to a vacuum source. The same applies to a box profile 56 of substantially triangular cross-section which forms the end of the box portion 28 and which is in communication with the interior of the box via a perforated wall 58 (see, for example FIG. 2) and is likewise connected to the line 54.

A compressed air channel 60 of rectangular cross-section is connected to the sloping lower end of the box profile 56 in such a manner that its cross-sectional axis is at an angle of approximately 45° to the transport surface 18. In the lower end wall facing the transport surface 18, the compressed air channel 60 carries a plurality of nozzles, not shown, which together produce an air curtain 62 which meets the printed products at an angle of 45°, counter to the product transport direction, as they leave the dusting device 22. That air curtain is for the most part sucked away through the openings in perforated wall 58, so that the air curtain forms altogether a roller of air of relatively large diameter which rotates counter to the product transport direction.

Figure 2:
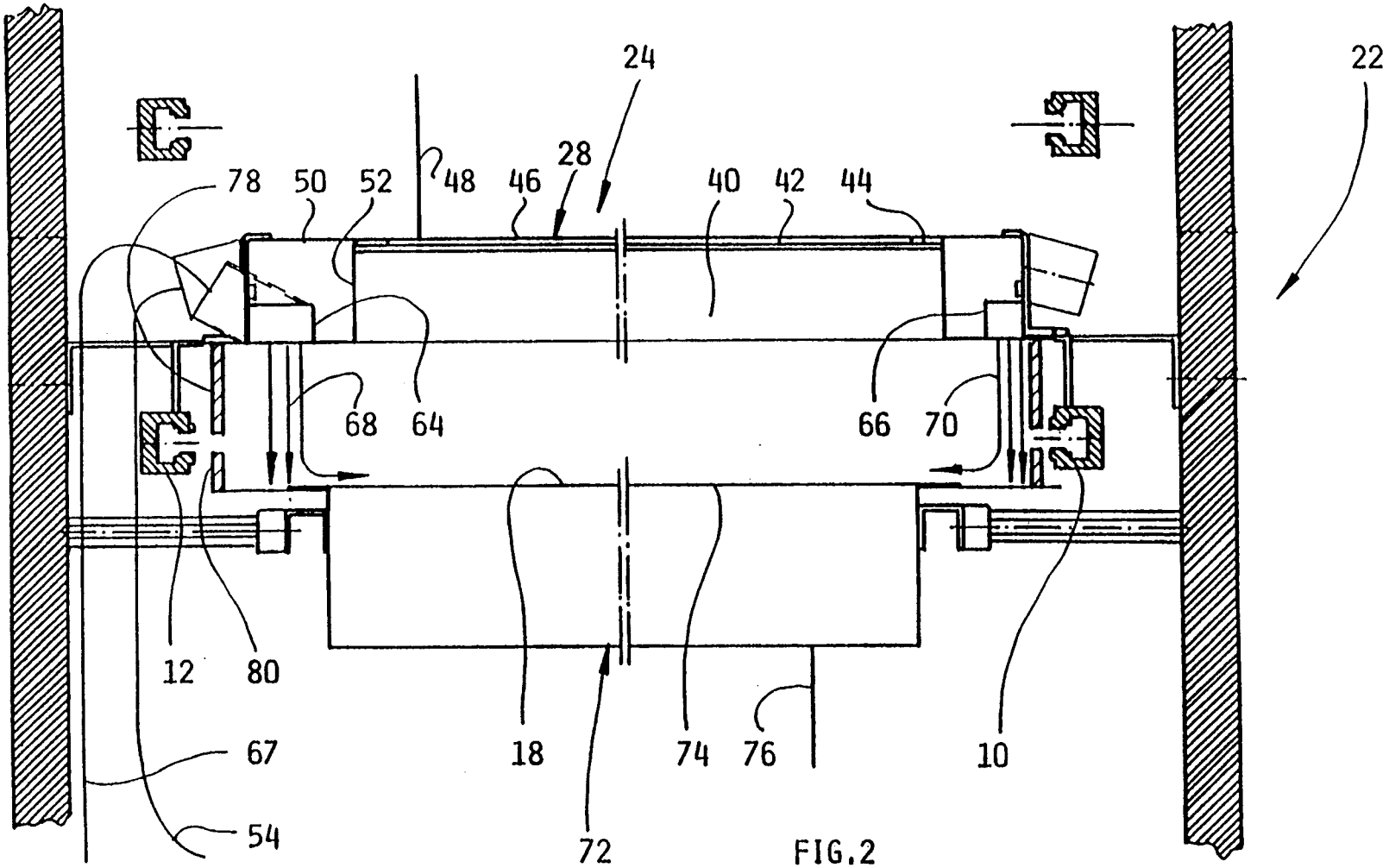
FIG. 2 shows a transverse section through the dusting device shown in FIG. 1, along the line of section II—II therein.

As will be seen from FIG. 2, compressed air channels 64, 66 are partitioned off by partition walls in the box profiles 50, which compressed air channels are again provided, in their walls lying at the bottom in FIG. 2, with a plurality of nozzles which, fed by a compressed air line 67, produce lateral air curtains 68, 70 directed towards the transport surface 18.

In order to ensure smooth transport of the printed products without buckling in the region of the dusting device 22, a sheet guide box, designated 72 overall, is provided therein beneath the transport surface 18. The sheet guide box is closed towards the transport surface by a perforated plate 74 having fine openings, and is connected to a vacuum line 76.

As will be seen from FIG. 2, there may be provided at the box profiles 50 sealing strips 78 which hang downward and extend into the immediate vicinity of the movement surface of the ends of the driving members, not shown, moved by the conveyor chains 14. Correspondingly, the sheet guide box 72 may carry sealing strips 80 extending as far as the movement surface of the fastening ends of the driving members.

The compressed air channel 60 is mounted on the powder box 24 in an electrically insulated manner and is connected to the one terminal of a high-voltage source 82 which delivers a voltage of 7.5 kV. The other terminal of the high-voltage source is connected to the powder box 24, thus generating an electric field from the compressed air channel 60 to the powder box 24, which additionally draws powder particles into the interior of powder box.

Figure 3:
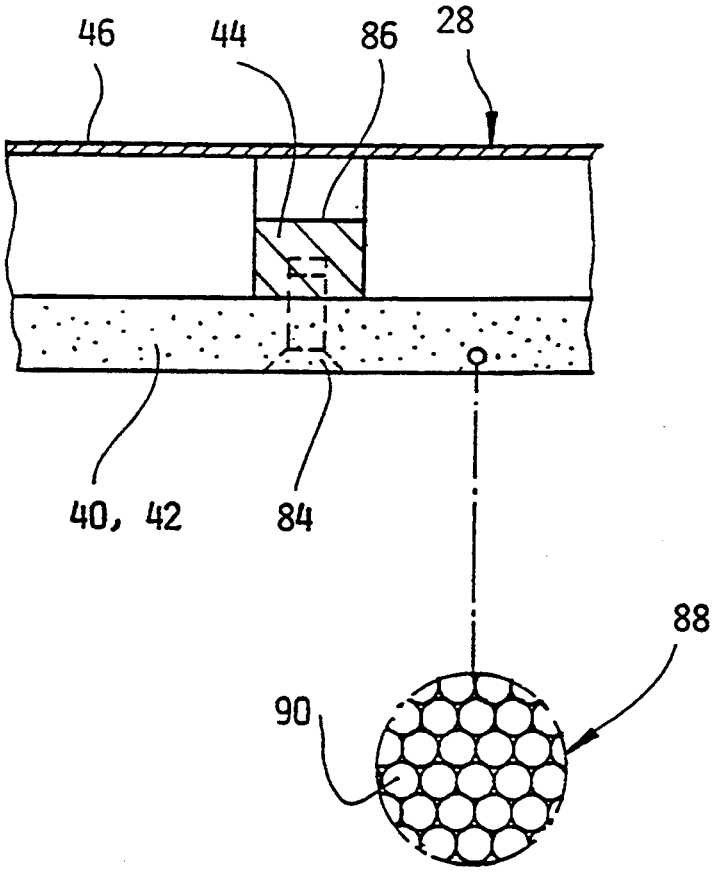
FIG. 3 shows an enlarged section through a part of a cover wall of the dusting device shown in FIGS. 1 and 2.

As will be seen from FIG. 3, the wall 40 and the wall 42 are fastened to the strips 44 by screws 84. The strips 44 have passages 86 so that the rear side of the microporous wall material is acted upon by compressed air throughout.

As shown in an enlarged cut-out 88, the wall material comprises very small particles 90 sintered together, which may consist, for example, of polyethylene. Such a material is mechanically self-supporting and has a very small pore size.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A device for dusting flat products, especially printed products, with powder, comprising:

a powder box which is open towards a product transport surface along which the flat products move in a product transport direction, said powder box having a back wall and side walls;

a powder nozzle arrangement which is arranged in the powder box transversely to the product transport direction and which delivers a powder/air mixture towards the product transport surface;

a first air nozzle arrangement arranged transversely to the product transport direction at an upstream edge of the powder box, and a second air nozzle arrangement arranged transversely to the product transport direction at a downstream edge of the powder box, said first and second air nozzle arrangements cooperating to produce an air curtain directed towards the product transport surface; and a first suction nozzle arrangement provided downstream of the first air nozzle arrangement and a second suction nozzle arrangement provided adjacent the second air nozzle arrangement, both the first and second suction nozzle arrangements being oriented transversely to the product transport surface, wherein a first portion of the back wall assigned to a downstream box portion is at a greater distance (H) from the product transport surface than is a second portion of the back wall assigned to an upstream box portion which is adjacent to the powder nozzle arrangement.

2. Dusting device according to claim 1, wherein:

a back wall of the downstream box portion is formed of an open-pored micropore material having a surface which faces away from an interior of the powder box and is acted upon by compressed air.

3. The device according to claim 1, wherein:

the second air nozzle arrangement produces an air curtain which has velocity components directed counter to the product transport direction.

4. The device according to claim 3, wherein:

the air curtain produced by the second air nozzle arrangement is inclined at approximately 45° to the product transport surface.

5. The device according to claim 1, further comprising:

a vacuum source; and wherein a downstream end wall of the powder box is provided with openings located over the second air nozzle arrangement, which openings are in communication with the vacuum source.

6. The device according to claim 1, further comprising:

a vacuum source; and wherein the side walls of the downstream box portion are provided with openings and are in communication with the vacuum source.

7. The device according to claim 1, further comprising:

a source of compressed air; and wherein the side walls of the powder box have additional air nozzle arrangements that are in communication with a source of compressed air.

8. The device according to claim 1, wherein:

the side walls of the powder box comprise seals.

9. The device according to claim 1, further comprising:

a sheet guide box which lies opposite the powder box in relation to the product transport surface, the sheet guide box having a guide wall which faces the product transport surface and is provided with a plurality of apertures; and a vacuum source, in communication with said plurality of apertures in the guide wall.

10. The device according to claim 9, wherein:

the sheet guide box has side walls which are provided with seals pointing towards the product transport surface.

11. The device according to claim 1, wherein:

the second air nozzle arrangement is electrically insulated from the downstream box portion, and comprises a high-voltage source, which provides a voltage in the range 3–8 kB and is connected to the downstream box portion and to the second air nozzle arrangement.

* * * * *